United States Patent [19]

Molins et al.

[11] 3,955,584

[45] May 11, 1976

[54] TOBACCO RECLAIMING APPARATUS IN CIGARETTE MAKING

[75] Inventors: Desmond Walter Molins; Eryk Stefan Doerman, both of London, England

[73] Assignee: Molins Limited, London, England

[22] Filed: July 3, 1974

[21] Appl. No.: 485,680

[30] Foreign Application Priority Data

July 12, 1973 United Kingdom ..... 73/33261

[52] U.S. Cl. ..... 131/96; 131/20 R; 131/21 R; 131/61 R; 131/65

[51] Int. Cl.² ..... A24C 1/04

[58] Field of Search ..... 131/20 R, 21 R, 21 D, 131/96, 25, 61, 65

[56] References Cited

UNITED STATES PATENTS

| | | | |
|---|---|---|---|
| 553,583 | 1/1896 | Hartigan | 131/96 |
| 589,883 | 9/1897 | Williams | 131/96 X |
| 1,582,544 | 4/1926 | Rundell | 131/96 X |
| 2,929,489 | 3/1960 | Parrish | 131/25 X |
| 2,951,364 | 9/1960 | Sherrill | 131/20 R X |
| 2,976,872 | 3/1961 | Morphet et al. | 131/96 |
| 3,088,467 | 5/1963 | Lanore | 131/20 R |
| 3,113,576 | 12/1963 | Bell | 131/21 D |
| 3,194,244 | 7/1965 | Powell | 131/21 B |
| 3,233,613 | 2/1966 | Korber et al. | 131/20 R |
| 3,244,183 | 4/1966 | Pym | 131/65 |
| 3,255,762 | 6/1966 | Baier | 131/96 X |
| 3,736,941 | 6/1973 | Molins et al. | 131/84 B |

FOREIGN PATENTS OR APPLICATIONS

| | | | |
|---|---|---|---|
| 1,103,929 | 3/1968 | United Kingdom | 131/20 R |
| 389,220 | 3/1933 | United Kingdom | 131/96 |
| 612,294 | 11/1948 | United Kingdom | 131/96 |
| 894,226 | 10/1953 | Germany | 131/96 |
| 763,999 | 12/1956 | United Kingdom | 131/96 |

*Primary Examiner*—Robert W. Michell
*Assistant Examiner*—V. Millin
*Attorney, Agent, or Firm*—, John C. Smith, Jr

[57] ABSTRACT

In continuous rod cigarette making machinery waste tobacco is collected from various sources (in particular from a stripping device for rejected cigarettes) and is fed to a separation box where non-tobacco waste is removed. The waste tobacco is then conveyed to a small hopper in which a carded drum meters the tobacco into the main tobacco shower at a point such that the surplus tobacco subsequently trimmed by the ecreteur does not consist of any waste tobacco, thereby minimising tobacco degradation. Waste tobacco may also be collected from the filter plug assembler by means of an inclined chute mounted over a conveyor which feeds the waste to the separation box.

6 Claims, 3 Drawing Figures

TOBACCO RECLAIMING APPARATUS IN CIGARETTE MAKING

Figure 1:
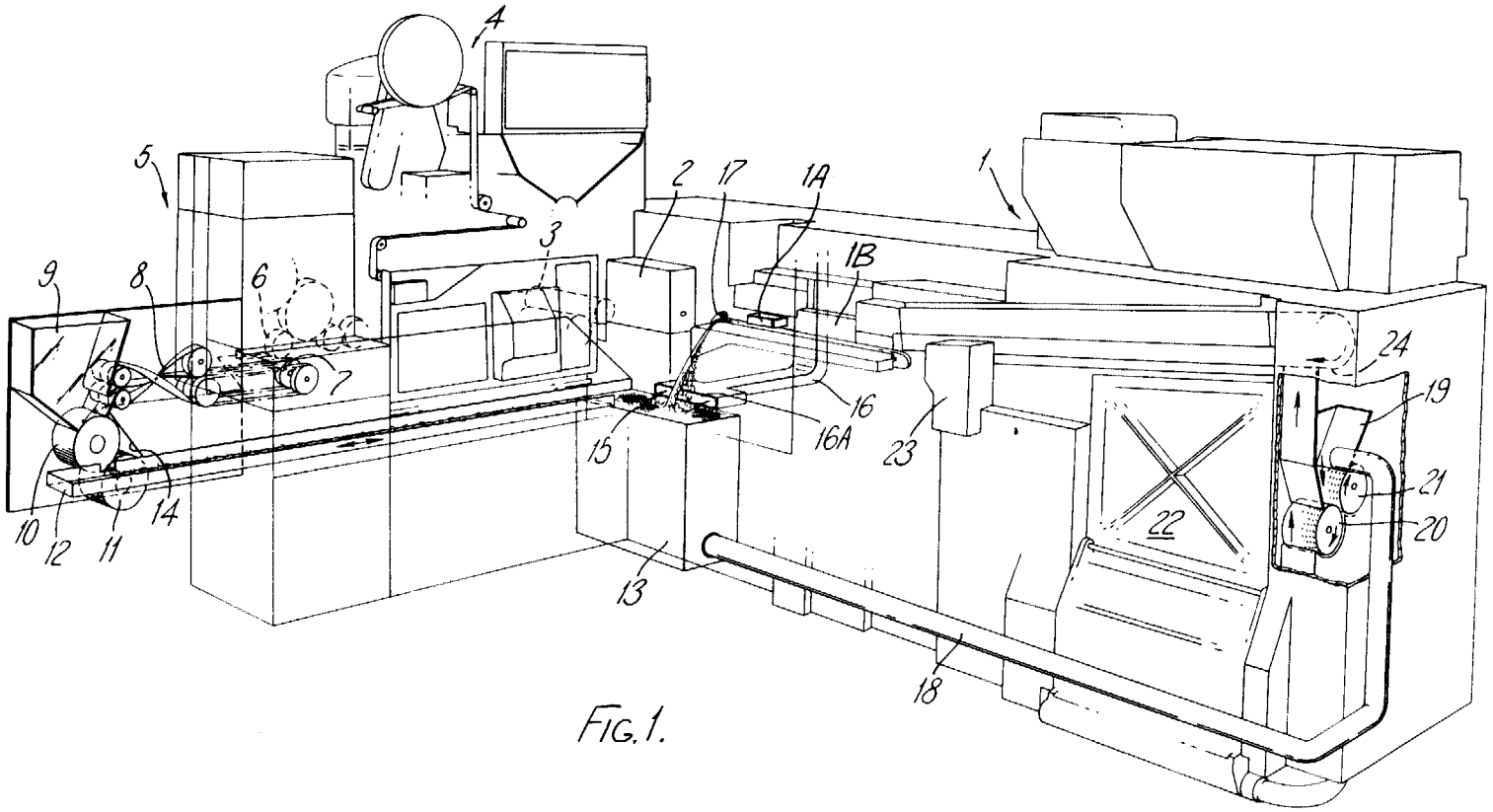

This invention concerns improvements in or relating to continuous rod cigarette making machinery and ancillary machines, and is more specifically concerned with reclaiming tobacco from such machinery.

In current high-speed cigarette making machines the cigarettes are subjected at several points in the machine to considerable dynamic forces which can cause particles of tobacco to be discarded from the ends of the cigarettes. Examples of such points are handling apparatus such as the catcher drum, in which cigarette lengths are collected after being severed at the cut-off, and (in the case of filter-tipped cigarettes) the plug assembler where considerable additional manipulation of the cigarettes is required. It is, of course, economically desirable to reclaim such particles of tobacco which are referred to herein as "waste tobacco".

Another source of waste tobacco which can be reclaimed is from the so called "long ends" of tobacco rod which are produced mainly when a blockage occurs at the entry to the cut-off, and the cigarette making machine is shut down.

However a most important source of waste tobacco occurs where cigarettes are rejected in an inspection machine, for example for being underweight. Tobacco from the reject cigarettes is removed in a cigarette stripping device, which tends to degrade the tobacco by breaking up the strands of tobacco and producing so called "shorts". This tobacco is conventionally reclaimed and re-utilised, after separation from other waste material, by being fed back into the main hopper of the cigarette making machine. However the subsequent carding and winnowing operations degrade the reclaimed tobacco even further, thereby appreciably reducing its filling capability. Whilst this might be acceptable if the proportion of reclaimed tobacco is small, the opposite is often the case. For example, the rejection rate of faulty cigarettes, and consequently the proportion of reclaimed tobacco, may have to be as high as 2% for the economic production of high quality cigarettes, i.e. ones having a narrow weight tolerance.

According to the present invention, in the method of making cigarettes in which a continuous tobacco filler stream is formed, is trimmed to remove surplus tobacco, and is wrapped to form a continuous cigarette rod, there are provided the steps of collecting waste tobacco from the cigarette making process to form a flow of tobacco, reducing variations in the rate of flow and introducing the flow of tobacco to form a part of the filler stream which will remain after the trimming operation.

The term "cigarette making process" as used in this specification includes not only the actual making of the cigarette rod, but also the assembling of cigarettes to filter plugs, their inspection, subsequent handling and packing. Thus the waste tobacco may, for example, be collected from points where manipulation of the cigarettes causes tobacco to be lost from their ends, or where a fault occurs in the manufacture of the cigarettes, or the tobacco may be that from inspected cigarettes which have been rejected.

Further according to the present invention, there is provided apparatus for making cigarettes, comprising a conveyor on which a continuous tobacco filler stream is conveyed, an ecreteur for trimming surplus tobacco from the filler stream which is then wrapped to form a continuous cigarette rod, means to collect waste tobacco from the cigarette making process to form a flow of waste tobacco, and means to reduce variations in the flow of waste tobacco and to introduce the waste tobacco to the filler stream to form a part thereof which will remain after the ecreteur has trimmed the surplus tobacco.

The means to reduce variations may comprise a hopper into which the waste tobacco is fed, and a coarse carded drum rotatably mounted at the base of the hopper to meter waste tobacco from the hopper for introduction to the region where the continuous tobacco filler stream is formed.

Figure 2:
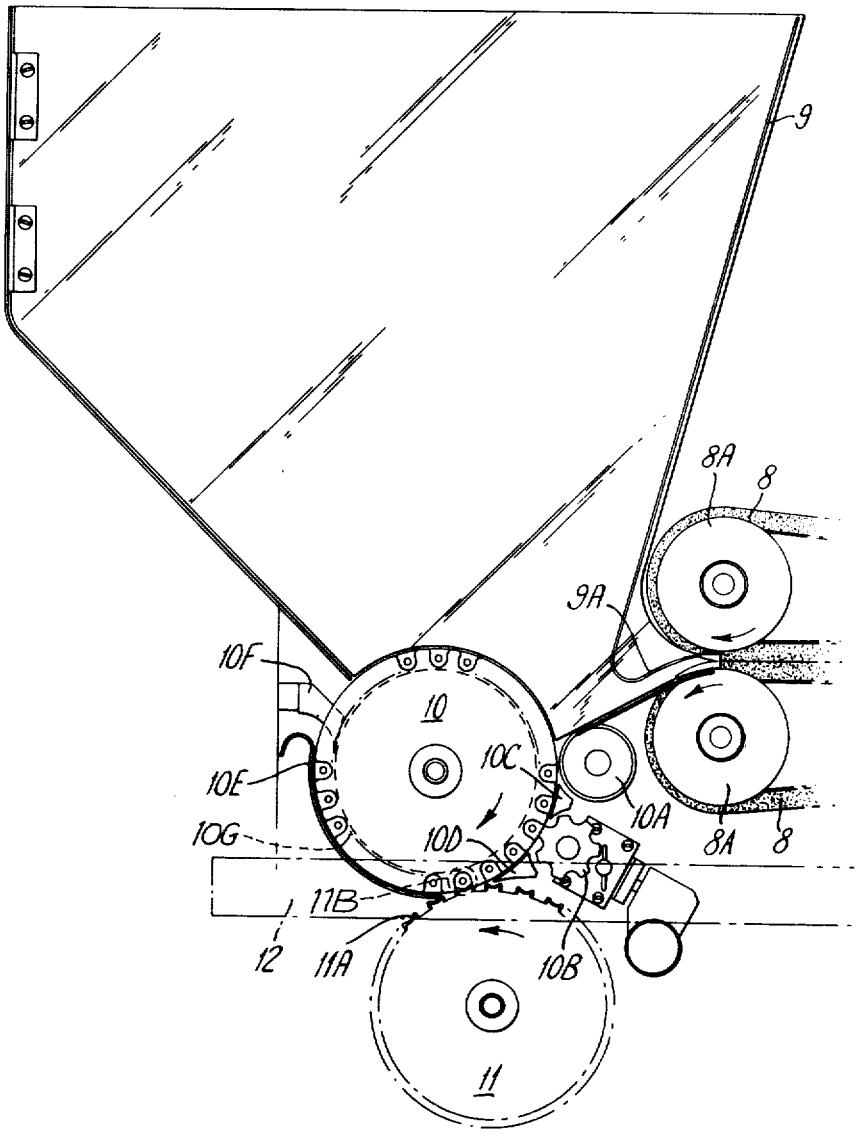
Figure 3:
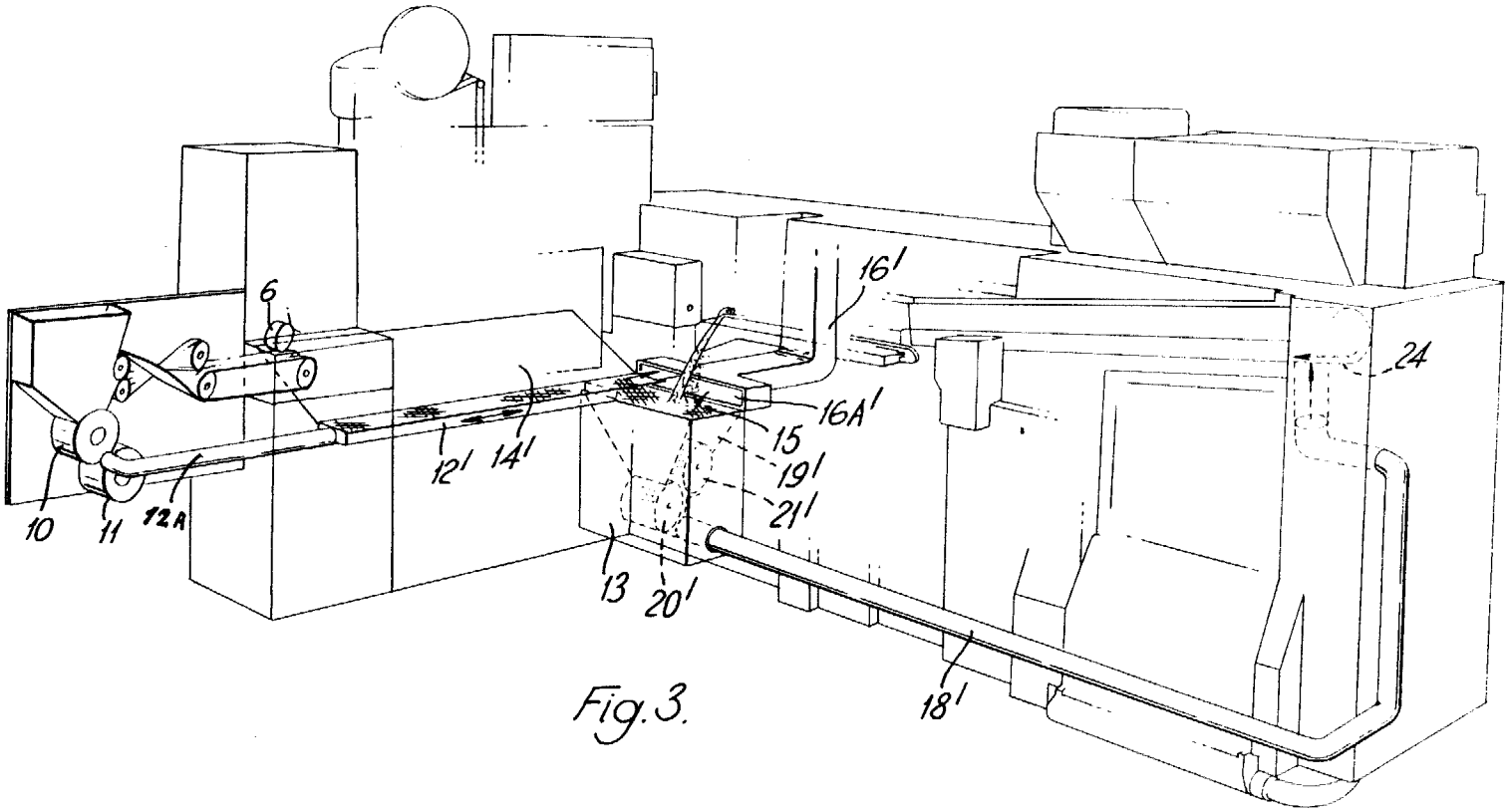

The invention will now be described by way of example with reference to the accompanying drawings, in which:

FIG. 1 is a perspective view of filter-tipped cigarette making and testing machinery embodying the present invention, FIG. 2 is a front view of part of the machinery shown to the left of FIG. 1, and FIG. 3 is a perspective view similar to FIG. 1 of filter-tipped cigarette making and testing machinery with further embodiments of the present invention.

A cigarette making machine, as disclosed for example in U.S. Pat. No. 3,089,497, is indicated in FIG. 1 generally by the reference numeral 1. The continuous cigarette rod is formed in a garniture or wrapping means 1B, as disclosed for example in U.S. Pat. No. 3,105,498 and the continuous rod so produced is severed into lengths at a cut-off 2. The cigarette lengths are then collected on a catcher drum 3 having flutes to which suction is applied to decelerate the cigarettes axially. From the catcher drum the cigarette lengths are fed into a plug assembler indicated generally by the reference numeral 4, in which filter plugs are united with the cigarette lengths to produce finished filter-tipped cigarettes. These cigarettes are fed into an inspection machine 5, which inspects them for faults by applying a suction test to their ends. The machine 5 shown is disclosed in British Pat. No. 1,195,682; however additional inspection machinery could be provided for testing other parameters, for example weight.

Acceptable cigarettes are fed away on a conveyor (not shown), while faulty ones are rejected and passed axially along a fluted drum 6 and on to a conveyor 7. A pair of known reversing bands 8 at the end of the conveyor 7 invert the faulty cigarettes so that their filter ends are pointing in a direction generally into the sheet of FIG. 1 of the drawings. The inspection machine 5 may, however, already receive the cigarettes from the plug assembler 4 in their correct orientation; in which case the reversing bands 8 will be replaced either by plain parallel bands, or by a correspondingly longer conveyor 7.

Cigarette Stripper.

The faulty cigarettes are fed by the bands 8 into a reservoir or hopper 9 of a known type of cigarette stripper device, disclosed in U.S. Pat. No. 3,757,799 of Rothman's of Pall Mall Canada Ltd. Essentially this consists of two fluted drums 10 and 11 between which the filter end of each successive cigarette is held by compression, while a blast of air pressure is applied to the filter end to force the tobacco out of its paper wrapper.

Referring now more particularly to FIG. 2, one side of the base of the hopper 9 is formed as a spout-shaped inlet 9A above and below which is positioned a pinch roller 8A. The rollers 8A each have a central groove into which fit the respective upper and lower foam-lined band 8. On each side of the grooves the peripheries of the rollers 8A are knurled, such that the filter-tipped cigarettes conveyed by the bands 8 are positively gripped between the rollers 8A and fed through the inlet 9A into the base of the hopper.

A refuser roller 10A ensures that only a single cigarette passes into each flute of the drum 10. Beyond the roller 10A is a compression roller 10B rotating at the same peripheral speed as the drum 10, but in the opposite direction. The roller 10B compresses the tobacco portion of the cigarette relative to the wrapper to facilitate subsequent expulsion of the tobacco. Guides 10C and 10D in front of and behind the roller 10B retain the cigarettes in the flutes of the drum 10.

Projections 11A on the periphery of the drum 11 successively clamp the filter portions of the cigarettes against the flutes in the drum 10 while a blast of air applied from a pipe 11B to the end of each filter portion expels the tobacco at the opposite end on to a vibrating conveyor trough 12.

The filters and empty wrappers are then carried further in the flutes of the drum 10, a guide 10E retaining them in the flutes. At the end of the guide 10E is positioned an extractor finger 10F which extends into a groove 10G formed in the drum 10 in order to remove each filter and empty wrapper.

The vibrating conveyor trough 12, which collects the stripped tobacco, conveys it to a separation box 13 (FIG. 1), the function of which will become apparent below. A mechanically operated detector, as for instance shown in U.S. Pat. No. 3,255,762 is fitted to the top of the hopper 9 to provide a suitable warning in the event that the hopper becomes overfilled, thus indicating a faulty trend in the cigarette making machine 1, or in the plug assembler 4.

An inclined chute 14 extends between the catcher drum 3 and the reversing band 8, i.e. beneath the plug assembler 4 and the inspection machine 5. The chute 14, which may also be arranged to be vibrated, slopes downwardly over the trough 12 so that any particles of tobacco shaken out of the cigarettes between the catcher drum and the reversing band 8 drop into the trough and are conveyed together with the stripped tobacco to the separation box 13. However, since little tobacco will fall from the cigarettes between the drum 6 and the cigarette stripper, the chute could alternatively terminate beneath the drum 6 as shown at 14' in FIG. 3. In this case the vibrating trough 12' could be shortened to the same length as the chute 14', the stripped tobacco from the drums 10 and 11 of the cigarette stripper being instead conveyed to the vibrating trough in an enclosed duct 12A by means of the blasts of air pressure produced at the stripper.

Other Waste Tobacco Sources.

A further source of tobacco which is from time to time fed to the separation box 13, is from the so called "long ends" of tobacco rod. These are formed mainly when a blockage occurs at the entry to the cut-off 2, and the cigarette machine 1 is thereby automatically shut down. When this happens the paster nozzle 1A for example as shown in German Pat. No. 2,258,017 and corresponding U.S. Pat. No. 3,815,822, which applies a line of adhesive to the wrapper of the rod, is automatically closed so that the tobacco rod formed while the machine is coming to rest is no longer sealed. At the same time a deflector arm 17 is actuated to deflect the end of the rod upstream of the cut-off 2 down to the box 13. The tobacco from the now non-sealed "long end" drops out into the box 13, and the empty wrapper can then be severed by hand and the arm 17 reset to allow the machine 1 to be restarted when the blockage has been cleared.

Yet another source of waste tobacco is that which is lost in handling apparatus, such as tray fillers (not shown), for receiving acceptable cigarettes from the inspection machine 5 for onward transmission to a cigarette packing machine. Such waste tobacco may be fed by a suitable conveyor (not shown) direct to the separation box 13.

Additionally, any cigarettes which are packed faultily by the packing machine may be extracted from the faulty packet and — in the same way as those rejected in the inspection machine — may be directed into the hopper 9 of the stripper device to produce further waste tobacco.

At the top of the separation box 13 is a vibrating sieve 15 which allows all the above mentioned sources of tobacco to pass through, but catches other material such as pieces of wrapper or filter plugs, hereinafter referred to as "non-tobacco waste". This material is removed, preferably at periodic intervals, by suction applied to the nozzle 16A of a pipe 16 extending between the sieve 15 and a waste collection point (not shown).

Tobacco Metering

Tobacco which falls into the box 13 is drawn by suction through a duct 18 into a small hopper 19 mounted to the right of the shower chimney 22 of the machine 1. Above the chimney 22 is a suction band 24 on the underside of which the continuous tobacco filler stream, which is later wrapped to form the continuous cigarette rod, is built up. The filler stream is formed progressively in depth from tobacco particles which are supplied from a main tobacco hopper (not shown) and impelled up the chimney 22 by means of an airstream caused by suction at the band 24. The chimney and suction band 24 are disclosed more fully in the above mentioned U.S. Pat. No. 3,089,497.

From the base of the hopper 19 the waste tobacco is metered at an even, relatively slow rate by a coarse carded drum 20 rotating clockwise, as shown in FIG. 1, against a gentle refuser drum 21 also rotating clockwise. The metered tobacco emerges at the front of the drum 20, and is entrained in a secondary upward airstream contained within guide walls (formed partly by the hopper 19) to the right of the chimney 22, such that the metered tobacco is showered on to the upstream end of the suction band 24. The filler stream deposited on the metered tobacco has a surplus of tobacco at all points along its length and this surplus tobacco is removed by a trimming device or ecreteur 23, which is described more fully in the above-mentioned U.S. Pat. No. 3,089,497. In this way the surplus tobacco which is trimmed from the filler stream on the suction band by the ecreteur 23 (and is subsequently recirculated) consists only of new tobacco from the main hopper of the machine, thereby preventing the progressive degradation of the filler stream. The design of the drums 20 and 21 is also such that the reclaimed waste tobacco is subjected to the minimum of manipulation to avoid breaking up the tobacco strands into smaller particles.

Miscellaneous

In the hopper 19 there are provided sensors which prevent over-filling of the hopper by controlling the suction applied to the duct 18, thereby smoothing out large, short-term variations in the supply of waste tobacco to the hopper 19. For example, there could occur sudden increases if for any reason a large number of "long ends" are produced by the cigarette machine 1.

Clearly the control of suction at the duct 18 could not, however, cope with long-term increases in the supply of waste tobacco, as caused for example by a continuous high rejection rate by the inspection machine 5 due to the requirement for a narrow tolerance in the weight of cigarettes, as mentioned above. In such a case the increase in waste tobacco would have to be absorbed (within acceptable limits) by an increase in the speeds of the drums 20 and 21. Possibly the feed rate of tobacco from the main hopper would then need to be reduced accordingly: this could be achieved, for example, by measuring the removal rate of tobacco from the ecreteur 23 and varying the feed of tobacco from the main hopper to maintain this removal rate constant. Alternatively the feed from the main hopper could be varied in proportion to the production rate of cigarettes which are accepted by the inspection machine 5.

Instead of being situated next to the chimney 22, the hopper 19' and drums 20' and 21' could be housed in the box 13 as shown in FIG. 3, the metered output then being drawn through a duct 18' directly to the upstream end of the suction band 24. The drums 20' and 21' may be driven either by a direct mechanical drive from carding drums (not shown) in the main tobacco hopper, or by an independent drive regulated preferably in response to the speed of the suction band 24.

The vibrating trough 12 could, as an alternative to the one shown, FIG. 1 be provided along its length with a sieve similar to the sieve 15 as shown in FIG. 3. Waste tobacco from the chute 14 would then pass to the bottom of the trough and be conveyed directly into the box 13. The nozzle 16A' of the pipe 16' would in this case be re-positioned at the end of the sieve above the trough 12 to draw off the other waste materials to the waste collection point. The sieve 15 would then serve to receive waste tobacco only from the "long ends", and need not be continuously vibrating.

We claim:

1. In the method of making cigarettes in which a continuous tobacco filler stream is formed and is trimmed to remove a portion thereof constituting surplus tobacco, and the remaining part of which is wrapped to form a continuous cigarette rod which is cut into individual cigarette lengths and united with filter tips, and in which the resulting filter tipped cigarettes are tested and defective cigarettes are rejected, the improvement comprising the steps of stripping tobacco from the rejected cigarettes to form an irregular flow of waste tobacco, collecting further particles from the uniting of such cigarette lengths and filter tips, adding the collected further particles to said irregular flow of waste tobacco, reducing variations in the rate of said irregular flow, and feeding said flow at a controlled rate to said remaining part of the filler stream which is not trimmed during the trimming operation.

2. Apparatus for making cigarettes, comprising a conveyor for conveying along a path a continuous tobacco filler stream which includes surplus tobacco, an ecreteur for trimming said surplus tobacco from the filler stream, garniture means for wrapping the trimmed filler stream in a wrapper and sealing the wrapper to form a continuous cigarette rod, means for cutting said rod into individual cigarette lengths, a machine for uniting filter tips with the said cigarette lengths to make filter tipped cigarettes, inspection means for testing the resultant cigarettes and rejecting defective cigarettes, a stripper device for separating waste tobacco from the rejected cigarettes to form an irregular flow of waste tobacco, and feed means for receiving said irregular flow of waste tobacco, and an inclined chute extending from said uniting machine for collection and delivery of particles of further waste tobacco produced by said machine to said feed means, said feed means being adapted to reduce variations in said irregular flow and to feed said flow at a controlled rate to a section of the filler stream along said path upstream from said ecreteur so that said waste tobacco becomes concentrated in the part of the filler stream which remains on said conveyor after trimming.

3. Apparatus according to claim 2 in which the feed means comprises a hopper for receiving the irregular flow of waste tobacco, an outlet at the bottom of the hopper, and a carded drum rotatably mounted at the outlet to control the feed of waste tobacco to the filler stream.

4. Apparatus according to claim 3 in which said conveyor is an air-pervious suction band, said apparatus further comprising a chimney below the suction band, suction means connected to the suction band to produce a primary airflow up the chimney for impelling tobacco particles towards the suction band, and a second airflow, the carded drum being positioned below the suction band on the upstream side of the chimney as considered in the direction of movement of the suction band, and guide means between the carded drum and the suction band up which waste tobacco is impelled by said secondary airflow produced by said suction means, whereby the waste tobacco is formed as a layer immediately below the suction band.

5. Apparatus according to claim 2 in which the stripper device comprises a reservoir having a base, and an inlet positioned adjacent the base for receiving filter tipped cigarettes rejected by said inspection means, and means to feed the rejected cigarettes to said inlet with their filter tips in a predetermined orientation, whereby the cigarettes received in the reservoir are maintained in said predetermined orientation.

6. Apparatus according to claim 2 in which said feed means for said irregular flow of waste tobacco is a vibrating conveyor, said apparatus further comprising a waste tobacco collection box, and a vibrating sieve mounted above the collection box for separating tobacco from non-tobacco waste, the vibrating conveyor passing at least from said inclined chute to said sieve.

* * * * *